US006286277B1

(12) United States Patent
Blöbaum et al.

(10) Patent No.: US 6,286,277 B1
(45) Date of Patent: Sep. 11, 2001

(54) SLIDING PANEL SYSTEM HAVING PANELS SLIDING ALONG AT LEAST ONE SLIDE RAIL ARRANGEMENT

(75) Inventors: Ernst-Udo Blöbaum, Leopoldshöhe; Reinhard Janutta, Verl, both of (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/498,193

(22) Filed: Feb. 4, 2000

Related U.S. Application Data

(63) Continuation-in-part of application No. PCT/EP98/04680, filed on Jul. 25, 1998.

(30) Foreign Application Priority Data

Aug. 7, 1997 (DE) ..... 197 34 179

(51) Int. Cl.[7] ..... E04B 1/346
(52) U.S. Cl. ..... 52/243.1; 52/64; 52/710
(58) Field of Search ..... 52/64, 243.1, 710; 160/196.1; 49/409, 208

(56) References Cited

U.S. PATENT DOCUMENTS

| | | | |
|---|---|---|---|
| 3,071,825 | 1/1963 | Ferris | 20/19 |
| 5,090,171 | 2/1992 | Kano et al. | 52/243.1 |

FOREIGN PATENT DOCUMENTS

| | | |
|---|---|---|
| 946597 | 8/1956 | (DE) . |
| 4015870 | 11/1991 | (DE) . |
| 0437029 | 7/1991 | (EP) . |

*Primary Examiner*—Carl D. Friedman
*Assistant Examiner*—N. Slack
(74) *Attorney, Agent, or Firm*—Nils H. Ljungman & Associates

(57) ABSTRACT

A sliding panel system whose sliding panel elements are aligned in a row next to each other when the sliding panel is closed and are positioned orthogonally in relation to the sliding panel when it is in its parked position. The individual sliding panel elements are guided on a first rail arrangement, a curved or bent rail section being adjacent to said slide rail in the transitional area leading to the parked position. The invention is characterized in that the slide rail has a curved or bent rail section in the transitional area leading to the parked position itself. When a point is switched immediately, said rail section opens up onto a parking rail running orthogonally or at an angle to the slide rail. The free end of the parking rail is configured so that it extends into the area of the sliding panel. At the same time, the last sliding panel element of the sliding panel is guided with its Front guide element (from the perspective of the closing direction) in the rail section and with its rear guide element exclusively in the parking rail, while all of the remaining sliding panel elements are guided in the rail section with both guide elements.

20 Claims, 4 Drawing Sheets

SLIDING PANEL SYSTEM HAVING PANELS SLIDING ALONG AT LEAST ONE SLIDE RAIL ARRANGEMENT

CONTINUING APPLICATION DATA

This application is a Continuation-In-Part application of International Patent Application No. PCT/EP98/04680, filed on Jul. 25, 1998, which claims priority from Federal Republic of Germany Patent Application No. DE 197 34 179.9, filed on Aug. 7, 1997. International Application No. PCT/EP98/04680 was pending as of the filing date of the above-cited application. The United States was an elected state in International Application No. PCT/EP98/04680.

BACKGROUND OF THE INVENTION

1. Field of the Invention

The present invention relates to a sliding panel system with at least one sliding panel that is guided on at least one slide rail and may be located between two lateral peripheral boundaries, the sliding panel elements of which panel system, when the sliding panel is closed, or when the sliding panels are closed, may be aligned in a row next to one another, and in the parked position may run orthogonally or mutually perpendicular to the slide rail, whereby associated with each sliding panel element there may be two guide elements that are located at some distance from each other in the sliding direction, are guided in at least one slide rail, and are preferably realized in the form of trucks or rollers, and there may be an additional curved or angled rail segment that is connected to the guide rail, in the transition area to the parked position.

2. Background Information

Some sliding panel elements are frequently realized in the form of glass panel facades and are conventionally suspended from a ceiling rail that is located in the vicinity of the crossbar or of the ceiling, whereby, however, the slide rail can also be a floor rail. The individual sliding panel elements, which in the closed position are located aligned in a row next to one another, must be moved into a parking or stowage position when the sliding panel is opened, for which purpose the individual panel elements, which are normally moved by motor power, although they can also be moved manually, are separated in the vicinity of their adjacent connecting edges and are moved into the parked position. The location and configuration of the parked position depends on the space available in the specific application. The movement of the sliding panel elements into the parked position can be done relatively easily if the individual sliding panel elements can be moved laterally in the parking area so that they are practically perpendicular or at right angles to the opening or closing direction, i.e., at a right angle to the longitudinal direction of the rail, as described in European Patent No. EP 0 437 029 A1. In that publication, with reference to the final sliding panel element in the closing direction, a relatively simple connection to a wall that runs orthogonally to the rail, for example, is possible. In the transition area to the parked position, there is a rail segment that branches off from the rail with the interposition of a switch, so that when the sliding panel is opened, the respective leading guide element continues to follow the curve of the rail, while the respective trailing guide element of a moving panel element is deflected by means of a switch into the branching rail segment. It is apparent that when the moving panel elements are moved into the parked position described in European Patent Application No. EP 0 437 029 A1, the free passage area of the sliding panel on an open moving wall is restricted.

If—as described in German Patent Publication No. DE 40 15 870 A1—the parking area is located in a recess, the side walls of which run parallel to and are aligned with the longitudinal direction of the slide rail, a relatively good connection is possible between the last sliding panel element in the closing direction and the adjacent wall of the recess. However, this arrangement requires the existence or addition of a parking recess.

However, in sliding panel systems described in some publications, there are special problems with regard to the achievement of a tight connection of the final sliding panel element in the closing direction, if the connection must be made with a wall that runs orthogonally to the slide rail and the wall that borders the slide rail, and if, in the parked position, the individual sliding panel elements are also supposed to be in a position that runs essentially orthogonally or at an angle to the slide rail, without restricting the free passage width of the sliding panel. For this purpose, a curved or angled rail segment that branches off from the rail is necessary for the pivoting movement of the individual sliding panel elements by approximately 90 degrees or more from the aligned position when the sliding panel is closed into the parked position, in which curved or angled rail segment the individual sliding panel elements are guided with both trucks so that they can execute the pivoting movement by approximately 90 degrees.

One particular problem with this arrangement is the realization of the transition to the parked position so that on one hand, the pivoting movement can be reliably executed, and on the other hand so that there is a connection between the first sliding panel element in the opening direction and the adjacent wall.

On the curved guides described in some publications, that is, the curved or angled rail segments that branch off from the rail, it was not possible to bring the free closing edge of the first sliding panel element in the opening direction up to the wall to which it was to be connected, which meant that it was necessary to have an additional intermediate element at this point, e.g. in the form of a pivot-hung door or a shutter. This arrangement was found to have problems, on one hand on account of the extra effort and expense it entailed, and on the other hand, when the sliding panel is open, such intermediate elements interfere with unrestricted access between the walls that are adjacent to the sliding panel itself on both sides.

OBJECT OF THE INVENTION

One possible object of the present invention, on a sliding panel arrangement system of the type described above, is to propose a solution in which the transitional area to the parked position is realized so that there is no need for an additional intermediate segment between the rear closing edge of the final sliding panel element in the closing direction and the wall, i.e., the curved guide can be realized so that when the sliding panel is closed, the above-referenced sliding panel element can be in direct contact by means of its closing edge with the adjacent wall. An additional possible object of the present invention is not to restrict the free width of the passage through the sliding panel when the sliding panel elements are moved into the parked position.

SUMMARY OF THE INVENTION

The invention teaches that one possible object of the present invention described above may be accomplished by use of a sliding panel system configured to form partitions and also configured to permit at least one sliding panel arrangement to be guided by guide arrangements on at least one rail arrangement.

The invention teaches that the slide rail that guides the sliding panel elements may not continue into the vicinity of an adjacent wall, a parking recess, or similar space, but in the vicinity of the parked position, i.e., in front of the "railroad station", has a curved or angled rail segment that emerges via a switch into a parking rail which is realized so that it runs orthogonally, perpendicularly, or at an angle to the rail. One essential feature of the invention is that the parking rail is extended beyond the vicinity of the switch junction toward the curve or path or profile of the sliding panel, i.e., the curve or path or profile of the sliding panel in the closed position, so that the last sliding panel element in the closing direction can be guided by means of its trailing guide element in the closing direction in this segment that is extended beyond the switch and forms the free end of the parking rail, while the leading guide element in the closing direction of the above-mentioned sliding panel element is forced into the angled or curved rail segment of the slide rail. In this manner, the final sliding panel element in the closing direction can be forcibly guided so that there is an essentially guaranteed tight connection between the above-mentioned sliding panel element and a peripheral boundary, which can be formed by a wall, for example. The realization of the guide elements or their roller guides is realized so that, when they interact with the above-mentioned switch, all the other sliding panel elements of the sliding panel run over the switch into the curved or angled rail segment of the slide rail.

In other words, in one possible embodiment of the present invention, the present invention teaches that the slide rail that guides the sliding panel elements may possibly not continue into the vicinity of an adjacent wall, a parking recess, or similar space, but in the vicinity of the parked position, i.e., in front of the "railroad station", such slide rail may have a curved or angled rail segment that emerges via a switch or intersection into a parking rail, which parking rail is realized so that it runs orthogonally, perpendicularly, or at an angle to at least the slide rail or slide rail arrangement. One essential feature of the invention may be that the parking rail is extended beyond the vicinity of the switch unction toward the curve or path or profile of the sliding panel, i.e., the curve or path or profile of the sliding panel in the closed position, so that the last sliding panel element in the closing direction can be guided by means of at least one of its guide elements or arrangements in the closing direction in this segment that is extended beyond the switch and forms the free end of the parking rail, while the leading guide element in the closing direction of the above-mentioned sliding panel element is forced into the angled or curved rail segment of the slide rail. In this manner, the final sliding panel element in the closing direction can be forcibly guided so that there is an essentially tight connection, contact, or adjacency between the above-mentioned sliding panel element and a peripheral boundary, which peripheral boundary can be formed by, for example, a wall, another sliding panel element, a barrier, or a solid surface. The guide elements or their roller guides may be realized so that, when they interact with the above-mentioned switch or intersection, all the other sliding panel elements of the sliding panel may run over the switch into the curved or angled rail segment of the slide rail.

The solution taught by the present invention therefore does not require the presence of an additional intermediate piece (such as a pivot-hung door panel, shutter, etc.), so that when the sliding panel system is open, i.e., when the sliding panel elements are in the parked position, there is an absolutely unrestricted passage between the walls that border the sliding panel.

In other words, in one possible embodiment of the present invention, the present invention may not require an additional intermediate piece (such as, for example, a pivot-hung door panel or shutter), so that when the sliding panel elements are open, i.e., when the sliding panel elements are in the parked position, there may be an essentially unrestricted passage between the walls bordering the sliding panel system.

In other words, in another possible embodiment of the invention, when sliding panel elements have been moved into the parking rail, persons may be able to move freely within the rooms formed by the sliding panel system—that is, without encountering, for example, a recess, a pivot-hung door panel, a shutter, a protruding object, or any obstacles to human movement other than walls or peripheral boundaries and the components of the sliding panel system, including, for example, curved rail segments, if used, the guide or slide rail, the parking rail, the end or extension of the parking rail, and the sliding panel elements. Thus such a sliding panel system provides essentially increased efficiency, simplicity, economy of installation, compactness, and safety.

For reasons of space availability, and in particular on sliding panels with an extraordinarily large passage width, it may be appropriate to locate the above-mentioned parking rail not in the vicinity of a side wall, for example, a peripheral boundary formed by a wall, but, for example, in the vicinity of an existing wall that runs between the peripheral boundaries themselves, approximately orthogonally to the sliding panel. In this case, the present invention teaches that it may be appropriate to provide sliding panel segments on both sides of the free end of the parking rail that are each guided so that they run into the vicinity of the closed sliding panel, and to associate with each sliding panel segment a rail segment of the slide rail in the transitional area to the parked position that is angled toward the parked position and emerges with the interposition of a switch into the parking rail.

The present invention also teaches that in one possible embodiment of the present invention, the arrangement can be advantageously configured so that one of the two final sliding panel elements in the closing direction is guided with its trailing guide element in the closing direction exclusively in the parking rail and its leading guide element in the associated rail segment, while the neighboring final sliding panel element in the closing direction is guided with both guide elements in the associated rail segment. The result is a tight connection between the last two sliding panel elements.

In other words, the present invention may also teach that in one possible embodiment of the present invention, the sliding panel system can be advantageously configured so that one of the two final sliding panel elements in the closing direction may be guided with its trailing guide element in the closing direction exclusively in the parking rail and with its leading guide element in the associated rail segment, while the neighboring final sliding panel element in the closing direction may be guided with both guide elements in at least one or at least two of the other rail arrangements. The result may be an essentially tight connection, contact, or adjacency between the last two sliding panel elements.

In an additional possible configuration of the present invention, the parking rail itself can form the parking area if it is realized so that it is sufficiently long. However, the parking rail can also be used as a short feeder rail to deliver the individual sliding panel elements into a parking position that can be configured in any desired manner. The parking rail is preferably oriented at an angle of between approximately 90 degrees and approximately 135 degrees with respect to the slide rail. In one possible embodiment of the present invention, it may be essential for the present invention that the free end of the parking rail is guided into the vicinity of the closed sliding panel far enough so that a connection between the final sliding panel element in the closing direction and the preceding sliding panel element is possible.

In one possible embodiment of the present invention, at least one sliding panel or sliding panel arrangement in the parking rail may be moved into a closed, parked, or stationary position so that at least one sliding panel or sliding panel arrangement may establish a tight connection, contact, or immediate adjacency with another sliding panel element or other peripheral boundary, wall, barrier, or solid surface on at least one side of the parking rail or parking rail extension.

In another possible embodiment of the present invention, at least one of the curved or angled rail segments may be disposed at a substantial angle to the other rail arrangements and may form switches, shunts, points, deflections, or intersections with other rail arrangements to facilitate the essentially smooth or easy travel or movement of sliding panel arrangements in the rail arrangements in such a way as to enable a person skilled in the art to easily determine such configurations and arrangements with essentially minimum experimentation or without undue experimentation.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and Applicants maintain that the present application may include more than one patentably and non-obviously distinct invention. The Applicants hereby assert that the disclosure of the present application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the three exemplary embodiments that are schematically illustrated in the accompanying drawings.

FIG. 1 shows the sliding panel with the parking rail running orthogonally to it;

FIG. 2 shows a second exemplary embodiment of the sliding panel, with a parking rail oriented at an angle of 135 degrees;

FIG. 3 shows the exemplary embodiment illustrated in FIG. 1 on an enlarged scale;

FIG. 4 shows a partial view of the sliding panel with sliding panel segments located on both sides of the parking rail.

DESCRIPTION OF THE PREFERRED EMBODIMENT

Figure 1:
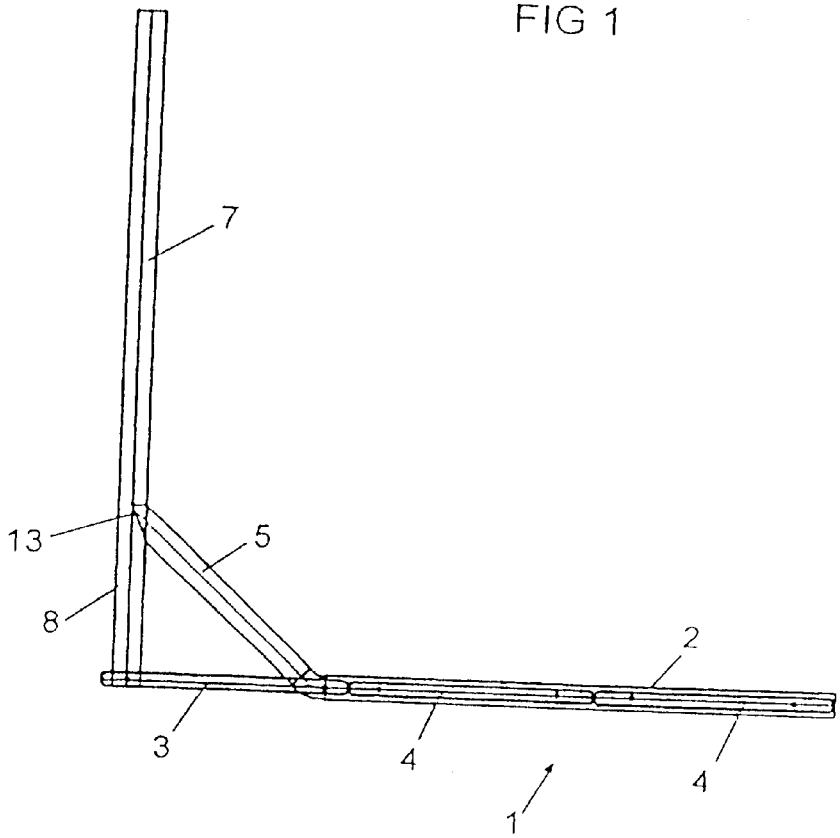
FIGS. 1 to 4 are schematic overhead views of the sliding panel claimed by the invention.

In FIG. 1, the sliding panel, which is designated 1 in general, is formed from one sliding panel segment 3 and two sliding panel segments 4. It goes without saying that the number of sliding panel segments 4 can be any higher number. The sliding panel segments 3 and 4 are guided in a slide rail that is designated 2, which does not extend into the vicinity of a free end 8 of a parking rail 7 but is bent at an angle by means of the rail segment 5. The rail segment 5 emerges via a switch 13 into the parking rail 7.

Figure 2:
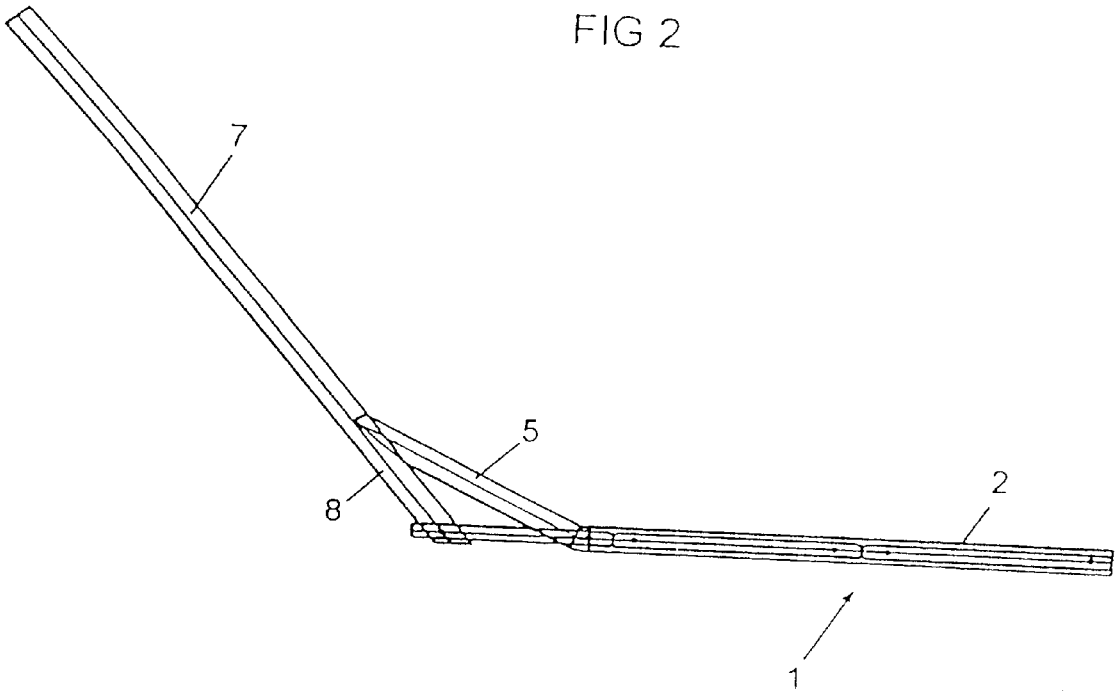

In FIG. 1, the parking rail 7 runs orthogonally to the rail 2, while in FIG. 2, the parking rail 7 is bent at an angle of approximately 135 degrees with respect to the rail 2.

Figure 3:
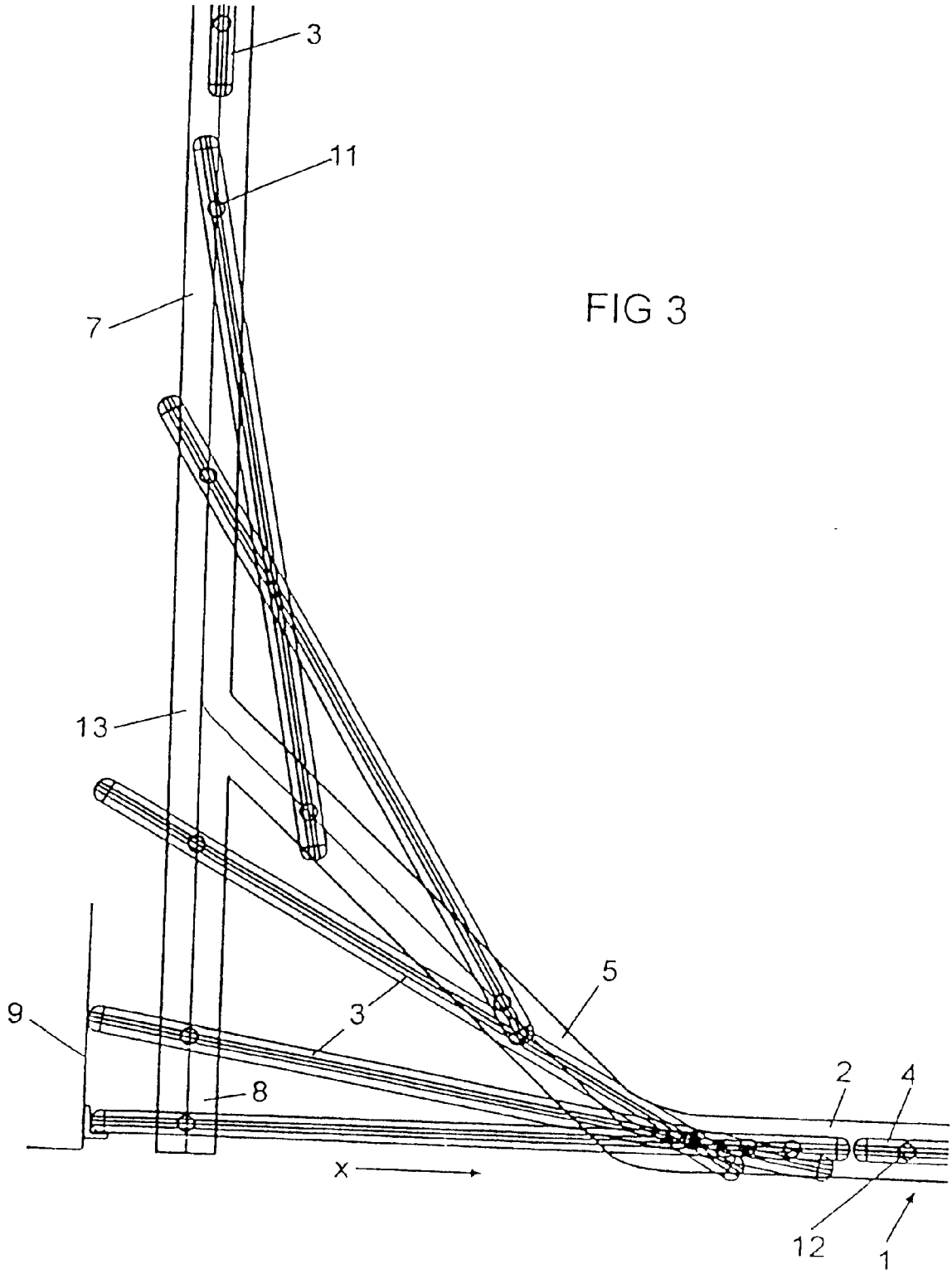
Figure 4:
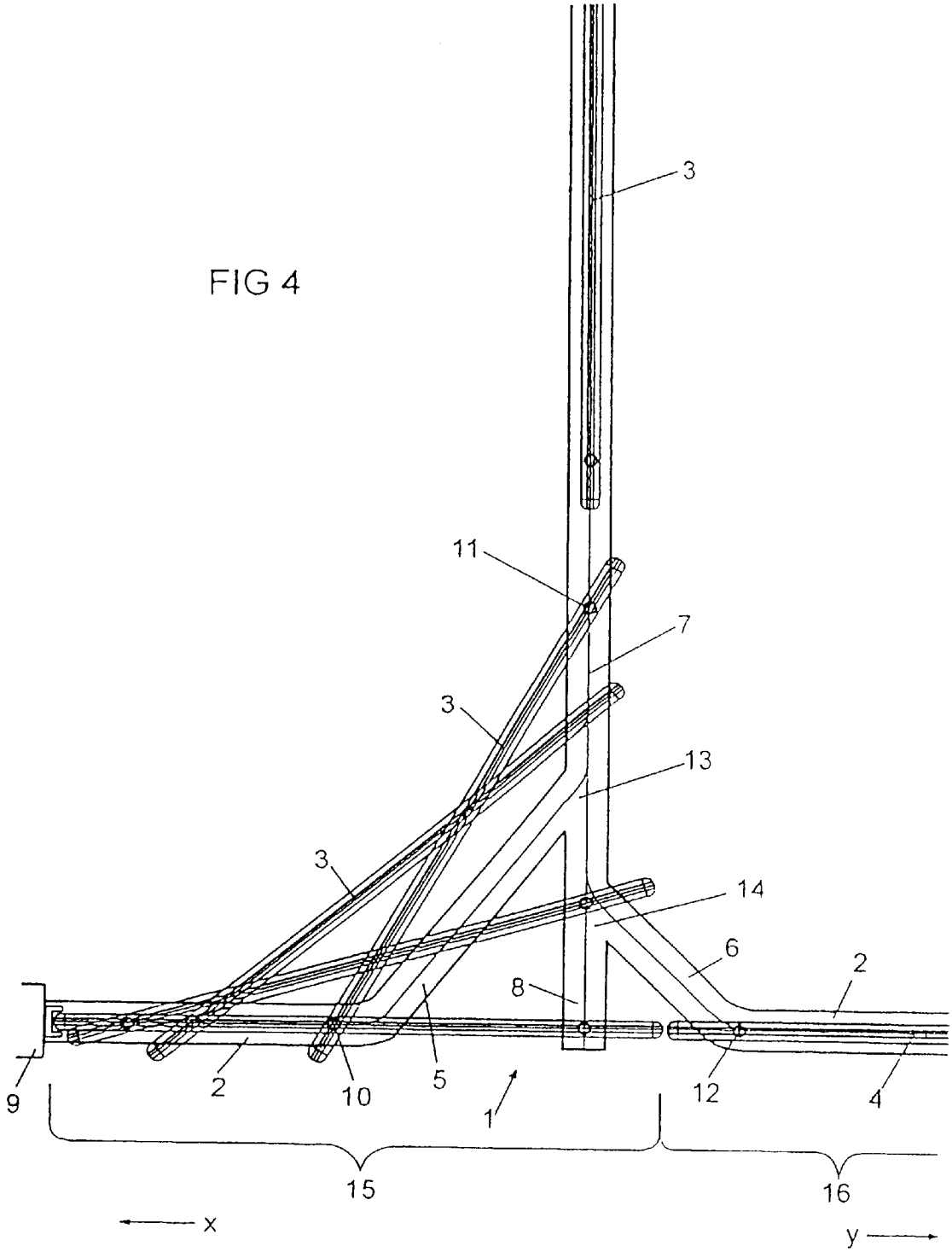

FIG. 3 shows the individual phases of movement of the last sliding panel element 3 in the closing direction (Arrow X) during the closing of the sliding panel 1. It is thereby assumed that the sliding panel element 4 with its two guide elements 12 (only one guide element 12 is shown) has first traveled through the parking rail 7, then traveled through the corresponding deflection in the switch 13 into the rail segment 5, and then entered the rail slide 2. The final sliding panel element 3 in the closing direction is also first guided with its two guide elements 10 (which guide element 10 is shown in FIG. 4) and 11 in the parking rail 7, whereby when it leaves the parking rail 7, the leading guide element 10 (as shown in FIG. 4) in the closing direction is deflected by the switch 13 into the rail segment 5, while the trailing guide element 11 in the closing direction travels through the switch 13 toward the free end 8 of the guide rail 7. It is apparent that a tight connection with the peripheral boundary 9, which in this case is formed by a wall, may thereby be possible.

In the exemplary embodiment illustrated in FIG. 4, the parking rail 7 is located at some distance from the peripheral boundary 9, so that on both sides of the parking rail 7 with reference to the sliding panel 1 there are rail segments 15, 16. The rail segment 15 in the exemplary embodiment is formed by a single sliding panel element which, when the rest of the wall is closed, for example, can represent a pivoting door that can be opened separately and moved into the parking position, as is desirable, for example, in passenger lounges if the public is to be permitted access to an automatic teller machine, for example, or to a similar device. FIG. 4 shows that the slide rails 2 that are located on both sides of the parking rail have rail segments 5 and 6 that are bent at an angle, whereby the rail segment 5 emerges via the switch 13 described above and the rail segment 6 may emerge via an additional switch 14 into the parking rail 7.

Starting from the assumption that all of the sliding panel elements 3, 4 are in the parked position, to close the sliding panel 1, first the sliding panel elements 4 may be moved in the closing direction Y into their closed position, whereby all of the sliding panel elements 4 may pass with their leading and trailing guide elements 12 in the closing directions first through the parking rail 7 and then via the switch 14, and then travel through the rail segment 6 and enter the associated rail 2, so that they assume the position illustrated in FIG. 4.

Then the sliding panel element 3 (or the additional sliding panel element, not shown, that precedes this sliding panel element 3) is moved out of the parked position, whereby the sliding panel element 3 is likewise guided in the closing direction X with its leading guide element 10 and its trailing guide element 11 first in the parking rail 7. As the closing operation proceeds, the leading guide element 10 in the closing direction is deflected via the switch 13 into the rail segment 5 while—as described with reference to FIG. 3—the trailing guide element passes through the switch 13 and enters the vicinity of the free end 8 of the parking rail 7, thereby resulting in the closed position of the sliding panel illustrated in FIG. 4. It is apparent that by means of the sliding panel element 3, tight connections to both the peripheral boundary 9 and to the adjacent sliding panel element 4 may be possible.

Figure 5:
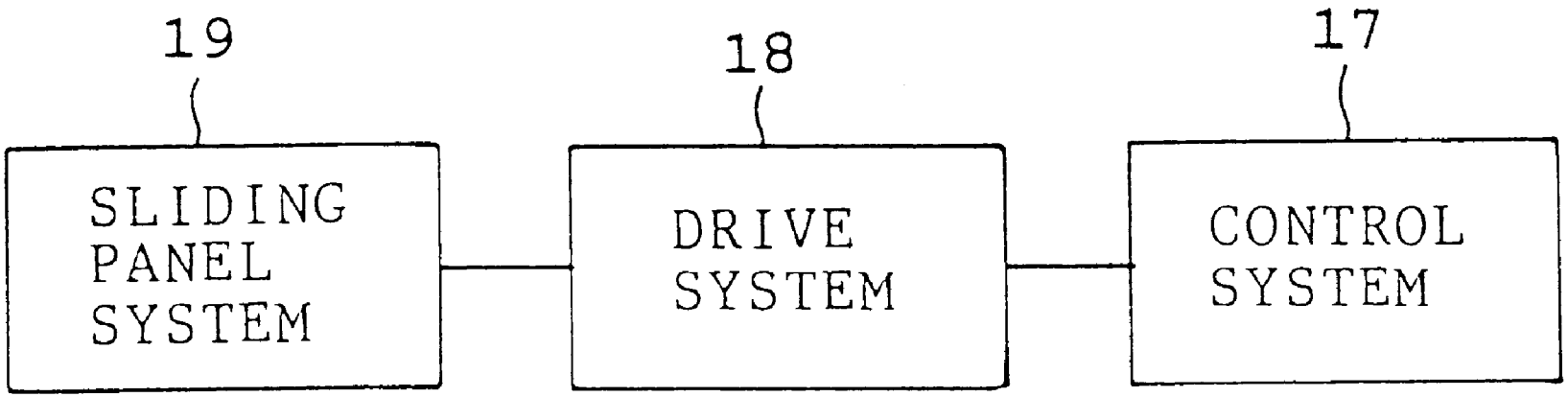
FIG. 5 is a block diagram showing the connection of a control system and a drive system to the sliding panel system.

FIG. 5 is a block diagram showing the connection between a control system 17 to control the sliding panel system 19, a drive system 18 to drive the sliding panel system 19, and the sliding panel system 19.

One feature of the invention resides broadly in the sliding panel that is guided on at least one slide rail and is located between two lateral peripheral boundaries, the sliding panel elements of which sliding panel, when the sliding panel is closed, are oriented aligned in a row next to one another, and in the parked position run orthogonally to the slide rail, whereby associated with each sliding panel element there are two guide elements that are located at some distance From each other in the sliding direction, are guided in at least one slide rail and are preferably realized in the form of trucks, and there is an additional curved or angled rail segment that is connected to the guide rail, in the transition area to the parked position, characterized by the fact that the slide rail 2 in the transition area to the parked position, has a rail segment 5, 6 that is curved or angled toward the parked position and emerges into a parking rail 7 that runs orthogonally or at any desired angle to the slide rail 2, whereby there is a switch 13, 14 between the rail segment 5, 6 and the parking rail 7, and that one free end 8 of the parking rail 7 is guided so that it runs into the vicinity of the closed sliding panel 1, and that the last sliding panel element 3 of the sliding panel 1 in the closing direction Arrow X is guided by means of its leading guide element 10 in the closing direction Arrow X in the rail segment 5 and by means of its trailing guide element 11 exclusively in the parking rail 7, while all the other sliding panel elements 4 are guided by means of both guide elements 12 in the rail segment 5, 6.

Another feature of the invention resides broadly in the sliding panel characterized by the fact that sliding panel segments 15, 16 are located on both sides of the end 8 of the parking rail 7 which is guided so that it runs into the vicinity of the closed sliding panel 1, and associated with each sliding panel segment 15, 16 is a rail segment 5, 6 of the slide rail 2 that is bent at an angle toward the parked position in the transition area to the parked position and emerges with the interposition of a switch 13, 14 into the parking rail 7.

Yet another feature of the invention resides broadly in the sliding panel characterized by the fact that one of the two last sliding panel elements 3 in the closing direction is guided by means of its trailing guide element 1 exclusively in the parking rail 7 and by means of its leading guide element 10 in the associated rail segment 5, while the other 4 of the last two moving panel elements is guided by means of both guide elements 12 in the associated rail segment 6.

Still another feature of the invention resides broadly in the sliding panel characterized by the fact that the parking rail 7 itself forms the parking area.

A further feature of the invention resides broadly in the sliding panel characterized by the fact that the parking rail 7 and the slide rail 2 enclose an angle between 90 degrees and 135 degrees.

One feature of the invention resides broadly in a sliding panel system configured to form partitions and also configured to permit at least one sliding panel arrangement to be guided by guide arrangements on at least one rail arrangement, said sliding panel system comprising: a control system to control said sliding panel system; a drive system to be driven by said control system; at least one first rail arrangement, said at least one first rail arrangement being configured to be disposed to permit movement of a sliding panel arrangement; a second rail arrangement, said second rail arrangement being configured to be disposed at an angle having a substantial magnitude to said at least one first rail arrangement; at least one third rail arrangement, said at least one third rail arrangement being configured to form at least one operative intersection to permit a sliding panel arrangement to move between said at least one first rail arrangement and said second rail arrangement; said at least one third rail arrangement being disposed at an angle having a substantial magnitude to said at least one first rail arrangement and said second rail arrangement; an operative intersection between said second rail arrangement and said at least one third rail arrangement; an operative intersection between said at least one first rail arrangement and said at least one third rail arrangement; said second rail arrangement comprising a fourth rail arrangement, said fourth rail arrangement extending generally away from said at least one first rail arrangement, said second rail arrangement, and said at least one third rail arrangement; said fourth rail arrangement being configured to be disposed to permit movement of a sliding panel arrangement; at least one guide arrangement, said at least one guide arrangement being configured to be disposed to be attached to and to guide at least one sliding panel arrangement along said rail arrangements; and said second rail arrangement being configured to be disposed to permit movement of a sliding panel arrangement along said fourth rail arrangement to permit establishment of tight contact between a sliding panel arrangement and a wall.

Another feature of the invention resides broadly in a sliding panel system configured to form partitions and also configured to permit movement of at least one sliding panel arrangement, said sliding panel system comprising: at least one first rail arrangement, said at least one first rail arrangement being configured to be disposed to permit movement of at least one sliding panel arrangement; a second rail arrangement, said second rail arrangement being configured to be disposed substantially adjacent to said at least one first rail arrangement; said second rail arrangement being disposed at an angle having a substantial magnitude to said at least one first rail arrangement; a third rail arrangement, said third rail arrangement extending generally away from said rail arrangements; and said third rail arrangement being configured to be disposed to permit movement of a sliding panel arrangement therealong to permit establishment of immediate adjacency between a sliding panel arrangement and another element, said other element comprising at least one of (a), (b), (c), (d), and (e), where (a), (b), (c), (d), and (e) are the following: (a) another sliding panel arrangement; (b) a wall; (c) a peripheral boundary; (d) a barrier; and (e) a solid surface.

Yet another feature of the invention resides broadly in a sliding panel system configured to form partitions and also configured to permit at least one sliding panel arrangement to be guided by guide arrangements on at least one rail arrangement, said sliding panel system comprising: at least one first rail arrangement, said at least one first rail arrangement being configured to be disposed to permit movement of a sliding panel arrangement; a second rail arrangement, said second rail arrangement being configured to be disposed substantially adjacent to said at least one first rail arrangement; said second rail arrangement being disposed at an angle having a substantial magnitude to said at least one first rail arrangement; a third rail arrangement, said third rail arrangement extending generally away from said rail arrangements; at least one guide arrangement, said at least one guide arrangement being configured to be disposed to be attached to and to guide at least one sliding panel arrangement along said rail arrangements; and said third rail arrangement being configured to be disposed to permit movement of a sliding panel arrangement therealong to permit establishment of immediate adjacency between a sliding panel arrangement and another element, said other element comprising at least one of (a), (b), (c), (d), and (e), where (a), (b), (c), (d), and (e) are the following: (a) another sliding panel arrangement; (b) a wall; (c) a peripheral boundary; (d) a barrier; and (e) a solid surface.

Still another feature of the invention resides broadly in a sliding panel 1 whose sliding panel elements 3, 4 are aligned in a row next to each other when the sliding panel is closed and are positioned orthogonally in relation to the sliding panel when it is in its parked position. The individual sliding panel elements 3, 4 are guided on a slide rail 2, a curved or bent rail section 5 being adjacent to said slide rail 2 in the transitional area leading to the parked position. The invention is characterized in that the slide rail 2 has a curved or bent rail section 5 in the transitional area leading to the parked position itself. When a point is switched immediately, said rail section opens up onto a parking rail 7 running orthogonally or at an angle to the slide rail 2. The free end 8 of the parking rail 7 is configured so that it extends into the area of the sliding panel 1. At the same time, the last sliding panel element 3 of the sliding panel 1 is guided with its front guide element 10 (from the perspective of the closing direction) in the rail section 5 and with its rear guide element 11 exclusively in the parking rail 7, while all of the remaining sliding panel elements are guided in the rail section 5 with both guide elements.

Some examples of housing or access panels which may be utilized or incorporated in at least one possible embodiment of the present invention may be found in U.S. Pat. No. 5,327,682, issued on Jul. 12, 1994.

Some examples of guide rails or systems for door, wall, or partition systems which may be utilized or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, sliding doors or panels, or door systems, and mechanisms and devices for their operation, which may be utilized or incorporated in at least one possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation which may be utilized or incorporated in at least one possible embodiment of the present invention may be found in the following U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of drive systems or drive arrangements which may be utilized or incorporated in at least one possible embodiment of the present invention may be found in the following U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of control arrangements or control systems which may be utilized or incorporated in at least one possible embodiment of the present invention may be found in the following U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; and U.S. Pat. No. 4,838,052, issued to inventors Williams et al. on Jun. 13, 1989.

Some examples of guides, rollers, guide elements, or guide arrangements which may possibly be used in at least one possible embodiment of the present invention may be found in the following U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of turnouts, turnout switches, or switches which may be utilized or incorporated in at least one possible embodiment of the present invention may be found in the following U.S. Pat. No. 5,577,691, issued to inventors Erich et al. on Nov. 26, 1996; U.S. Pat. No. 5,375,797, issued to inventor Willow on Dec. 27, 1994; U.S. Pat. No. 4,970,964, issued to inventors Burg et al. on Nov. 20, 1990; U.S. Pat. No. 4,970,962, issued to inventors Burg et al. on Nov. 20, 1990; U.S. Pat. No. 4,890,804, issued to inventors Teramoto et al. on Jan. 2, 1990; and U.S. Pat. No. 4,005,839, issued to inventor Frank on Feb. 1, 1977.

The components disclosed in the various patents, patent applications, and publications, disclosed or incorporated by reference herein may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications, and publications recited herein, and in the Declaration attached hereto, are hereby incorporated by reference as if set forth in their entirety herein.

The corresponding foreign and international patent publication applications, namely, Federal Republic of Germany Patent Application No. 197 34 179.9, filed on Aug. 7, 1997, having inventors -Udo Blöbaum and Reinhard Janutta, and DE-OS 197 34 179.9, DE-PS 197 34 179.9, and International Application No. PCT/EP98/04680, which International Application was filed on Jul. 25, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A sliding panel system configured to form partitions and also configured to permit at least one sliding panel arrangement to be guided by guide arrangements on at least one rail arrangement, said sliding panel system comprising:

a control system to control said sliding panel system;

a drive system to be driven by said control system;

at least one first rail, said at least one first rail being configured to be disposed to permit movement of said at least one sliding panel arrangement;

a sole, second, parking, rail, said sole, second, parking, rail being configured to be disposed at an angle having a substantial magnitude to said at least one first rail ;

at least one third rail, said at least one third rail being configured to form at least one operative intersection to permit a sliding panel arrangement to move between said at least one first rail and said second rail;

said at least one third rail being disposed at an angle having a substantial magnitude to said at least one first rail and said second, parking, rail;

an operative intersection between said sole, second, parking, rail and said at least one third rail;

an operative intersection between said at least one first rail and said at least one third rail;

said sole, second, parking rail comprising a fourth rail, said fourth rail extending generally away from said at least one first rail, said second, parking, rail, and said at least one third rail;

said fourth rail being configured to be disposed to permit movement of a sliding panel arrangement;

at least one guide arrangement, said at least one guide arrangement being configured to be disposed to be attached to and to guide at least one sliding panel arrangement along said rails; and said second, parking, rail being configured to be disposed to permit movement of a sliding panel arrangement along said fourth rail to permit establishment of tight contact between a sliding panel arrangement and a wall; and said fourth rail being aligned with said sole parking rail to permit one of said at least one guide arrangement of one of said at least one sliding panel arrangement to move from said first rail to said fourth rail and thus permit establishment of tight contact between a sliding panel arrangement and a wall, upon said sliding panel arrangement being simultaneously guided by said fourth rail.

2. The sliding panel system according to claim 1, wherein:

said at least one guide arrangement comprises a plurality of guide arrangements to guide a plurality of sliding panel arrangements, said plurality of guide arrangements being configured to be disposed to be attached to and to guide their corresponding sliding panel arrangements;

said sliding panel system further comprises:

at least one fifth rail arrangement, said at least one fifth rail arrangement being configured to be disposed to guide said at least one guide arrangement therealong;

at least one sixth rail arrangement, said at least one sixth rail arrangement being configured to be disposed to guide said at least one guide arrangement therealong;

said at least one sixth rail arrangement is configured to be disposed at an angle having a substantial magnitude to said second rail arrangement;

said at least one fifth rail arrangement is configured to form at least one operative intersection to permit a sliding panel arrangement to move between said second rail arrangement and said at least one sixth rail arrangement;

said at least one fifth rail arrangement is disposed at an angle having a substantial magnitude to said second rail arrangement and said at least one sixth rail arrangement;

an operative intersection between said second rail arrangement and said at least one fifth rail arrangement; and an operative intersection between said at least one fifth rail arrangement and said at least one sixth rail arrangement; and said intersections are configured to guide said at least one guide arrangement between said rail arrangements connected to said intersections.

3. The sliding panel system according to claim 2, wherein said at least one guide arrangement is configured to be disposed a predetermined distance from an end of a sliding panel arrangement to permit establishment of immediate adjacency between a sliding panel arrangement and said wall.

4. The sliding panel system according to claim 3, wherein:

said at least one guide arrangement comprises a first guide arrangement and a second guide arrangement;

said first guide arrangement is configured to be disposed to be attached to and to permit movement of a sliding panel arrangement along at least two of (I), (II), (III), (IV), and (V), where (I), (II), (III), (IV), and (V) are the following:

(I) said at least one first rail arrangement;

(II) said second rail arrangement;

(III) said at least one third rail arrangement;

(IV) said at least one fifth rail arrangement; and (V) said at least one sixth rail arrangement; and said second guide arrangement is configured to be disposed to be attached to and to guide a sliding panel arrangement along said fourth rail arrangement.

5. The sliding panel system according to claim 4, wherein said at least one first rail arrangement and said second rail arrangement form an angle between approximately 90 degrees and approximately 135 degrees.

6. The sliding panel system according to claim 5, wherein said second rail arrangement is configured to be disposed to be operatively aligned with said fourth rail arrangement such that said at least one guide arrangement moves substantially along a straight path between said second rail arrangement and said fourth rail arrangement.

7. A sliding panel system configured to form partitions and also configured to permit movement of at least one sliding panel arrangement, said sliding panel system comprising:

at least one first rail, said at least one first rail being configured to be disposed to permit movement of at least one sliding panel arrangement;

a sole second, parking, rail, said sole second, parking rail being configured to be disposed substantially adjacent to said at least one first rail;

said sole second, parking rail being disposed at an angle having a substantial magnitude to said at least one first rail;

a third rail, said third rail extending generally away from said other rails; and said third rail being configured to be disposed to permit movement of a sliding panel arrangement along said third rail to permit establishment of immediate adjacency between a sliding panel arrangement and a wall, upon said sliding panel arrangement being simultaneously guided by said third rail.

8. The sliding panel system according to claim 7, wherein said sliding panel system further comprises:

at least one fourth rail arrangement, said at least one fourth rail arrangement being configured to form at least one operative intersection to permit a sliding panel arrangement to move between said at least one first rail arrangement and said second rail arrangement;

said at least one fourth rail arrangement is disposed at an angle having a substantial magnitude to said at least one first rail arrangement and said second rail arrangement;

an operative intersection between said second rail arrangement and said at least one fourth rail arrangement; and an operative intersection between said at least one first rail arrangement and said at least one fourth rail arrangement.

9. The sliding panel system according to claim 8, wherein said sliding panel system further comprises:

at least one guide arrangement, said at least one guide arrangement being configured to be disposed to be attached to and to guide at least one sliding panel arrangement along said rail arrangements;

said at least one guide arrangement comprises a plurality of guide arrangements to guide a plurality of sliding panel arrangements, said plurality of guide arrangements being configured to be disposed to be attached to and to guide their corresponding sliding panel arrangements;

at least one fifth rail arrangement, said at least one fifth rail arrangement being configured to be disposed to guide said at least one guide arrangement therealong;

at least one sixth rail arrangement, said at least one sixth rail arrangement being configured to be disposed to guide said at least one guide arrangement therealong;

said at least one sixth rail arrangement is configured to be disposed at an angle having a substantial magnitude to said second rail arrangement;

said at least one fifth rail arrangement is configured to form at least one operative intersection to permit a sliding panel arrangement to move between said second rail arrangement and said at least one sixth rail arrangement;

said at least one fifth rail arrangement is disposed at an angle having a substantial magnitude to said second rail arrangement and said at least one sixth rail arrangement;

an operative intersection between said second rail arrangement and said at least one fifth rail arrangement;

an operative intersection between said at least one fifth rail arrangement and said at least one sixth rail arrangement; and said intersections are configured to guide said at least one guide arrangement between said rail arrangements connected to said intersections.

10. The sliding panel system according to claim 9, wherein said at least one guide arrangement is configured to be disposed a predetermined distance from an end of a sliding panel arrangement to permit establishment of immediate adjacency between a sliding panel arrangement and said wall.

11. The sliding panel system according to claim 10, wherein:

said at least one guide arrangement comprises a first guide arrangement and a second guide arrangement;

said first guide arrangement is configured to be disposed to be attached to and to permit movement of a sliding panel arrangement along at least two of (I), (II), (III), (IV), and (V), where (I), (II), (III), (IV), and (V) are the following:

(I) said at least one first rail arrangement;

(II) said second rail arrangement;

(III) said at least one fourth rail arrangement;

(IV) said at least one fifth rail arrangement; and (V) said at least one sixth rail arrangement; and said second guide arrangement is configured to be disposed to be attached to and to guide a sliding panel arrangement along said third rail arrangement.

12. The sliding panel system according to claim 11, wherein said at least one first rail arrangement and said second rail arrangement form an angle between approximately 90 degrees and approximately 135 degrees.

13. The sliding panel system according to claim 12, wherein said second rail arrangement is configured to be disposed to be operatively aligned with said third rail arrangement such that said at least one guide arrangement moves substantially along a straight path between said second rail arrangement and said third rail arrangement.

14. A sliding panel system configured to form partitions and also configured to permit at least one sliding panel arrangement to be guided by guide arrangements on at least one rail arrangement, said sliding panel system comprising:

at least one first rail, said at least one first rail being configured to be disposed to permit movement of a sliding panel arrangement;

a second, parking rail, said second, parking rail being configured to be disposed substantially adjacent to said at least one first rail;

said second, parking, rail being disposed at an angle having a substantial magnitude to said at least one first rail;

a third rail, said third rail extending generally away from said first, said second, and said third rails;

at least one guide arrangement, comprising a first guide arrangement and a second guide arrangement, said at least one guide arrangement being configured to be disposed to be attached to and to guide at least one sliding panel arrangement along said rail arrangements; and said third rail being configured to be disposed to permit movement of said first guide arrangement of a sliding panel arrangement along said third rail to permit establishment of immediate adjacency between a sliding panel arrangement and a wall; and a fourth rail being operatively connected with said second, parking, rail and extending generally away from said first, said second, and said third rails to permit said second guide arrangement of said sliding panel arrangement to move from said first rail to said fourth rail and thus permit establishment of immediate adjacency between a sliding panel arrangement and a wall, upon said sliding panel arrangement being simultaneously guided by said fourth rail.

15. The sliding panel system according to claim 14, wherein:

said at least one guide arrangement comprises a plurality of guide arrangements to guide a plurality of sliding panel arrangements, said plurality of guide arrangements being configured to be disposed to be attached to and to guide their corresponding sliding panel arrangements; and said sliding panel system further comprises:

at least one fourth rail arrangement, said at least one fourth rail arrangement being configured to form at least one operative intersection to permit a sliding panel arrangement to move between said at least one first rail arrangement and said second rail arrangement;

said at least one fourth rail arrangement is disposed at an angle having a substantial magnitude to said at least one first rail arrangement and said second rail arrangement;

an operative intersection between said second rail arrangement and said at least one fourth rail arrangement; and an operative intersection between said at least one first rail arrangement and said at least one fourth rail arrangement.

16. The sliding panel system according to claim 15, wherein said sliding panel system further comprises:

at least one fifth rail arrangement, said at least one fifth rail arrangement being configured to be disposed to guide said at least one guide arrangement therealong;

at least one sixth rail arrangement, said at least one sixth rail arrangement being configured to be disposed to guide said at least one guide arrangement therealong;

said at least one sixth rail arrangement is configured to be disposed at an angle having a substantial magnitude to said second rail arrangement;

said at least one fifth rail arrangement is configured to form at least one operative intersection to permit a sliding panel arrangement to move between said second rail arrangement and said at least one sixth rail arrangement;

said at least one fifth rail arrangement is disposed at an angle having a substantial magnitude to said second rail arrangement and said at least one sixth rail arrangement;

an operative intersection between said second rail arrangement and said at least one fifth rail arrangement;

an operative intersection between said at least one fifth rail arrangement and said at least one sixth rail arrangement; and said intersections are configured to guide said at least one guide arrangement between said rail arrangements connected to said intersections.

17. The sliding panel system according to claim 16, wherein said at least one guide arrangement is configured to be disposed a predetermined distance from an end of a sliding panel arrangement to permit establishment of immediate adjacency between a sliding panel arrangement and said wall.

18. The sliding panel system according to claim 17, wherein:

said at least one guide arrangement comprises a first guide arrangement and a second guide arrangement;

said first guide arrangement is configured to be disposed to be attached to and to permit movement of a sliding panel arrangement along at least two of (I), (II), (III), (IV), and (V), where (I), (II), (III), (IV), and (V) are the following:

(I) said at least one first rail arrangement;

(II) said second rail arrangement;

(III) said at least one fourth rail arrangement;

(IV) said at least one fifth rail arrangement; and (V) said at least one sixth rail arrangement; and said second guide arrangement is configured to be disposed to be attached to and to guide a sliding panel arrangement along said third rail arrangement.

19. The sliding panel system according to claim 18, wherein said at least one first rail arrangement and said second rail arrangement form an angle between approximately 90 degrees and approximately 135 degrees.

20. The sliding panel system according to claim 19, wherein said second rail arrangement is configured to be disposed to be operatively aligned with said third rail arrangement such that said at least one guide arrangement moves substantially along a straight path between said second rail arrangement and said third rail arrangement.

* * * * *

UNITED STATES PATENT AND TRADEMARK OFFICE

CERTIFICATE OF CORRECTION

PATENT NO. : 6,286,277 B1
DATED : September 11, 2001
INVENTOR(S) : Ernst Udo Blőbaum and Reinhard Janutta It is certified that error appears in the above-identified patent and that said Letters Patent is hereby corrected as shown below:

Column 7,
Line 52, after 'element' delete "1" and substitute -- 11 --.

Column 11,
Line 56, after 'inventors' delete "-Udo" and substitute -- Ernst-Udo --.

Column 12,
Line 54, after 'rails;' delete "and".

Signed and Sealed this

Eighteenth Day of June, 2002

*Attest:*

*Attesting Officer*

JAMES E. ROGAN
*Director of the United States Patent and Trademark Office*